US006955057B2

(12) United States Patent
Taras et al.

(10) Patent No.: US 6,955,057 B2
(45) Date of Patent: Oct. 18, 2005

(54) CONTROL SCHEME AND METHOD FOR DEHUMIDIFICATION SYSTEMS AT LOW AMBIENT CONDITIONS

(75) Inventors: Michael F. Taras, Fayetteville, NY (US); Thomas J. Dobmeier, Phoenix, NY (US); Ruddy C. Bussjager, Cicero, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/610,857

(22) Filed: Jun. 30, 2003

(65) Prior Publication Data

US 2004/0261436 A1 Dec. 30, 2004

(51) Int. Cl.[7] ..... F25B 29/00; F25D 17/00

(52) U.S. Cl. ..... 62/173; 62/181; 62/196.4; 62/228.3

(58) Field of Search ..... 62/173, 196.4, 62/181, 228.3, 150, 180, 183, 184

(56) References Cited

U.S. PATENT DOCUMENTS 5,419,149 A * 5/1995 Hara et al. ..... 62/160
5,651,258 A 7/1997 Harris
5,704,217 A * 1/1998 Itoh et al. ..... 62/150
5,706,664 A * 1/1998 Hara ..... 62/159
6,055,818 A * 5/2000 Valle et al. ..... 62/173
6,484,520 B2 * 11/2002 Kawaguchi et al. ..... 62/133
6,834,511 B2 * 12/2004 Hatakeyama ..... 62/173

FOREIGN PATENT DOCUMENTS

EP 0 355 180 2/1990
EP 0 760 452 A2 3/1997

* cited by examiner

*Primary Examiner*—Marc Norman
(74) *Attorney, Agent, or Firm*—Bachman & LaPointe, PC

(57) ABSTRACT

A method for operating a vapor compression system includes the steps of providing a vapor compression system having a compressor circuit including a compressor having an inlet port and an outlet port, a circuit incorporating the compressor, a condenser, an evaporator and an expansion device for sequentially generating a cooling refrigerant for cooling a stream of air so as to provide a dehumidified cooled stream of air, and a reheat refrigerant for heating the dehumidified cooled stream of air to provide a reheated dehumidified stream of air; controlling discharge pressure from the compressor outlet so as to increase discharge pressure from the compressor outlet. Furthermore, system dehumidification performance is improved in terms of latent capacity boost, undesired sensible capacity reduction, latent efficiency enhancement, and recovery of supply air temperature to a desired level.

10 Claims, 3 Drawing Sheets

CONTROL SCHEME AND METHOD FOR DEHUMIDIFICATION SYSTEMS AT LOW AMBIENT CONDITIONS

BACKGROUND OF THE INVENTION

The invention relates to vapor compression systems with enhanced dehumidification capability and, more particularly, to operation of such vapor compression systems to provide dehumidification at low ambient conditions and improvement of such operation.

Operation of vapor compression systems to provide a dehumidification function of an indoor space along with minimum sensible cooling is sometimes necessary. This function is provided utilizing three main design approaches, each of which employs main refrigerant flow, or a portion thereof, for reheat of the dehumidified and overcooled air stream.

The first concept uses compressor discharge gas re-routed to a reheat coil of the system which is placed in the indoor section behind the evaporator and connected sequentially with the main condenser. This allows reheat of the indoor air stream to reduce sensible capacity, after the air stream has been cooled to provide the desired dehumidification.

A second concept also employs compressor discharge gas in a similar fashion with the exception that the reheat coil is placed in parallel arrangement with the main condenser, and the main condenser is taken out of the circuit in the dehumidification mode of operation.

A third approach uses a portion of the compressor discharge gas which is bypassed around the main condenser coil and mixed with the main flow routed through the condenser coil, as usual. The combined flow is then directed through the reheat coil, located behind the evaporator coil, for the reheat function of indoor air stream.

At low ambient conditions, the foregoing methods can result in undesirable two-phase flow at the inlet of the expansion device of the system as well as evaporator freeze-up. Furthermore, when operating at low compression ratios, system dehumidification efficiency can suffer in terms of lost latent capacity, increased sensible capacity, reduction in supply air temperature and drop of the system latent efficiency.

It is clear that the need remains for an improved method for operating a vapor compression system for providing dehumidification at low ambient conditions.

It is therefore the primary object of the present invention to provide such a method.

It is a further object of the present invention to provide a method for operating a vapor compression system wherein dehumidification is provided with enhanced system efficiency even at low ambient conditions.

Other objects and advantages of the present invention will appear hereinbelow.

SUMMARY OF THE INVENTION

In accordance with the present invention, the foregoing objects and advantages have been readily attained.

According to the invention, a method is provided for operating a vapor compression system, which method comprises the steps of providing a vapor compression system having a compressor circuit including a compressor having an inlet port and an outlet port, a circuit incorporating said compressor, a condenser, an evaporator and an expansion device for sequentially generating a cooling refrigerant for cooling a stream of air so as to provide a dehumidified cooled stream of air, and a reheat refrigerant for heating said dehumidified cooled stream of air to provide a reheated dehumidified stream of air; and controlling discharge pressure from said compressor outlet port whereby discharge pressure is increased, and two-phase flow of refrigerant to said expansion device and evaporator freeze-up can be avoided. Additionally, the system dehumidification performance is enhanced through a boost of evaporator latent capacity, elimination of undesirable sensible capacity, recovering of supply air temperature to a desired level and an increase of the system latent efficiency. This also provides for increased system reliability through avoidance of mechanical failures due to flooding and the like.

Various methods can be utilized for controlling the discharge pressure of the compressor, with the advantage of this control being that two-phase flow to the expansion device and evaporator coil freeze-up are eliminated, system latent efficiency and life-cycle cost of the equipment are boosted, moisture removal and system latent capacity are enhanced, and undesired sensible capacity can readily be reduced. Such methods include but are not limited to discharge line restriction, cycling of outdoor fans, implementation of variable speed drives, bypassing a portion of the condenser coil, etc.

BRIEF DESCRIPTION OF THE DRAWINGS

A detailed description of preferred embodiments of the present invention follows, with reference to the attached drawings, wherein.

DETAILED DESCRIPTION

The invention relates to a vapor compression system and method for operating same wherein dehumidification is allowed at low ambient conditions while avoiding two-phase flow to the expansion device, avoiding evaporator coil freeze-up and improving overall system dehumidification efficiency and reliability.

Figure 1:
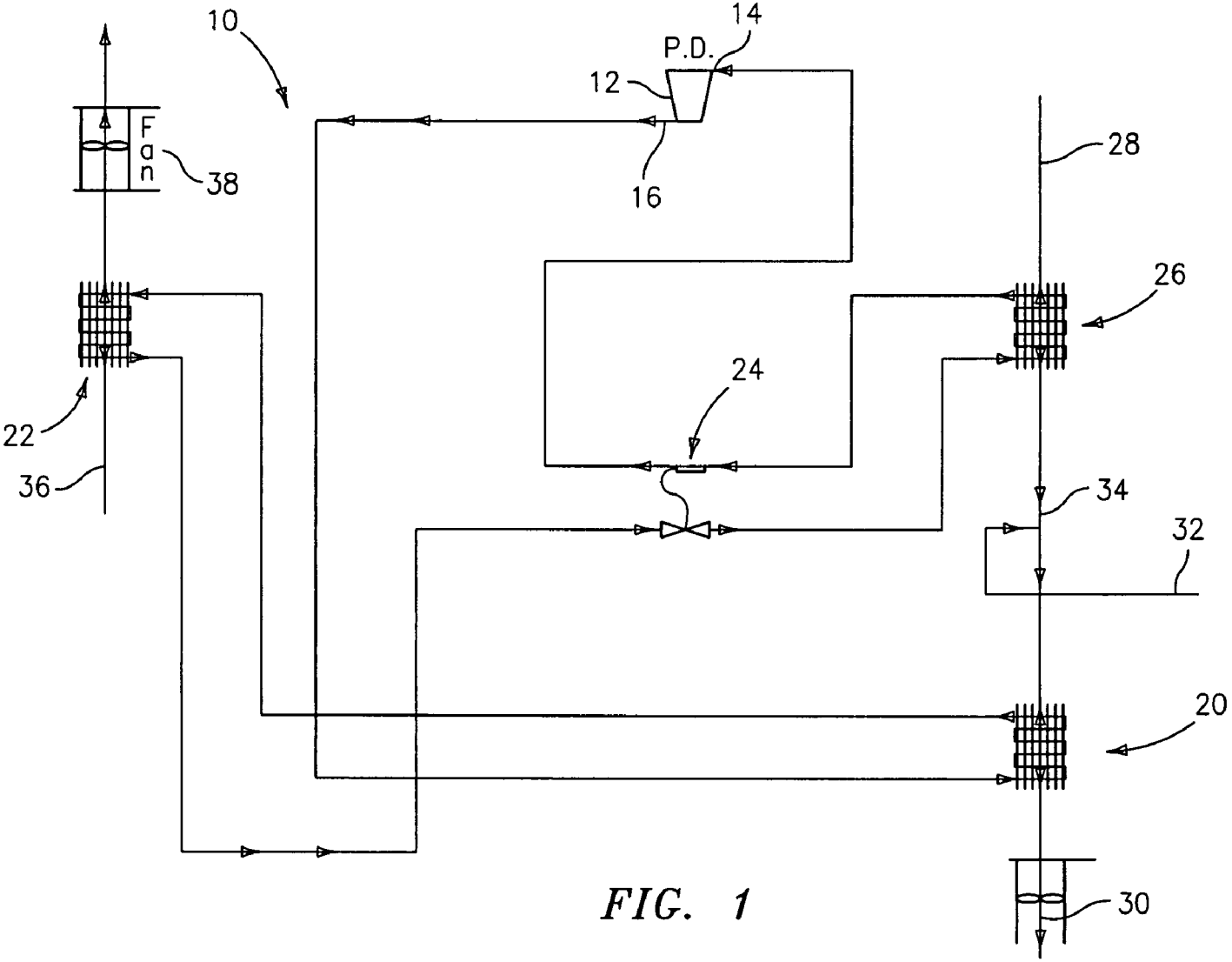
FIG. 1 illustrates a vapor compression system utilizing hot compressor gas for air reheat in accordance with the present invention.

FIG. 1 shows a system 10 in accordance with the present invention which includes a compressor 12 having an inlet port 14, an outlet port 16 and refrigerant lines which lead in series to a plurality of components including a reheat coil 20 for reheating of overcooled and dehumidified indoor air, a main condenser 22 for cooling refrigerant with outside air, expansion device 24, evaporator 26 for cooling and dehumidifying of indoor air and back to inlet port 14 of compressor 12.

When system 10 is operated in a dehumidification mode, indoor air 28 is passed through evaporator 26 and cooled so as to remove moisture. This can frequently result in air which is cooled beyond the desired temperature, or overcooled air, and so air is directed from evaporator 26 to coil 20 where hot gas from compressor 12 reheats the stream of air which is then passed through fan 30 to the conditioned space. In this manner, air within the space can be dehumidified with substantially zero sensible capacity as desired. In order to provide the desired dehumidification, it may be preferred to treat only a portion of the air stream, and thus air from a bypass 32 can advantageously be re-introduced to duct 34 from evaporator 26 to be mixed with the main air stream as shown in the drawing.

In further accordance with the invention, the operation of system 10 at low ambient conditions has been found to provide potential problems during operation, especially in a dehumidification mode. Problems include the potential for feed of a two-phase flow to expansion device 24, freezing of the evaporator coil in the system and adverse impact upon dehumidification performance of the system. Further at low ambient conditions, some compressors cannot operate properly and may malfunction due to low compression ratios.

In accordance with the present invention, these potential problems are resolved through implementation of head pressure control, or control discharge pressure at port 16 of compressor 12, which advantageously provides for elimination of two-phase flow to expansion device 24, avoids freezing of evaporator coil 26 within the system, enhances efficiency of the system and nevertheless provides for enhanced moisture removal and system latent capacity along with reduction in undesired sensible capacity and recovery of supply air temperature during dehumidification at low ambient conditions.

The system of FIG. 1 utilizes outside air 36 to further cool refrigerant in condenser 22, and one method for controlling the discharge pressure from compressor 12 is to control the speed of fan 38 so as to control the cooling of refrigerant in condenser 22 which in turn allows for controlling latent and sensible capacity of the evaporator coil 26 and thus the state of refrigerant entering expansion device 24 and in turn the state of air flowing into an occupied space. It should be understood that less precise methods of control can be implemented for example by cycling on and off the outdoor fans.

An alternative manner in which pressure leaving compressor 12 can be controlled to provide the desired results includes the positioning of a flow restriction or control device in the discharge line from compressor 12.

In further accordance with the invention, a portion of the condenser coil 22 can be bypassed utilizing a part of the condenser heat transfer surface to control the condensation process of refrigerant.

Figure 2:
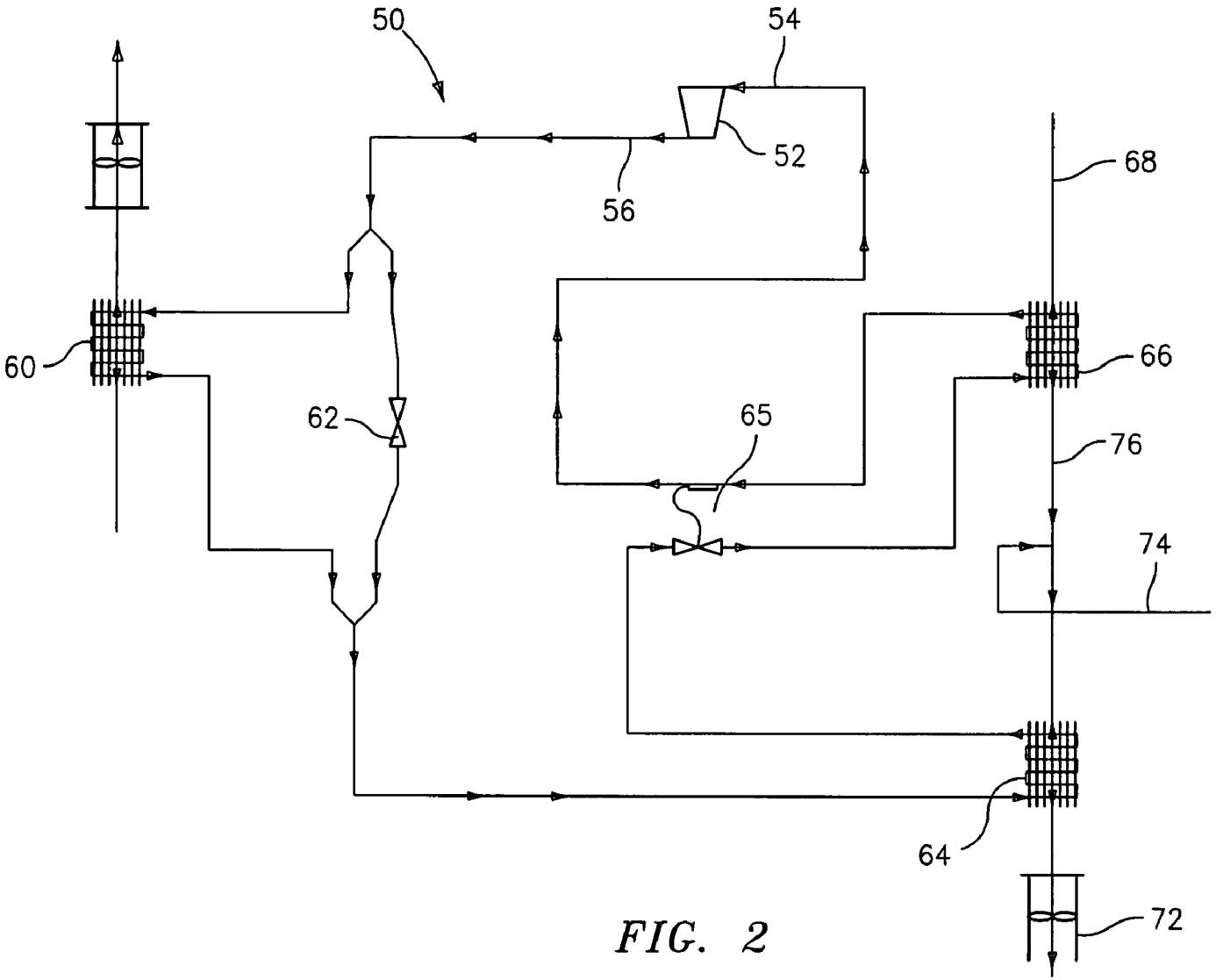
FIG. 2 illustrates a vapor compression system utilizing two-phase vapor and liquid refrigerant for reheat of the indoor air stream.

Turning to FIG. 2, an alternative system 50 is illustrated wherein a compressor 52 is provided having an inlet port 54 and an outlet port 56 along with refrigerant lines leading sequentially to condenser 60 and control valve 62 in parallel. From there, the refrigerant lines combine and lead to reheat coil 64, expansion device 65 and evaporator 66, and from evaporator 66 back to inlet port 54 of compressor 52.

In system 50, as in system 10, indoor air 68 is passed through evaporator 66 for cooling and removal of moisture, and then is directed through reheat coil 64 for reheating to a desired temperature. The air stream is pulled by fan 72 and flows back to the conditioned space as desired.

As in the embodiment of FIG. 1, only a portion of the air stream may desirably be passed through evaporator 66 for cooling and removal of moisture, and thus a bypass line 74 can advantageously be provided which bypasses evaporator 66 with at least a portion of air from the indoor air flow 68 or an outside air intake, and is then combined with line 76 flowing from evaporator 66 to reheat coil 64 as desired.

In accordance with the invention, the system of FIG. 2 is likewise controlled so as to allow for dehumidification at low ambient conditions without two-phase flow in expansion device 65, without freezing of evaporator coil 66, and with enhanced system dehumidification performance and efficiency as is desired in accordance with the present invention.

Dehumidification systems, especially those including air reheat utilizing the main refrigerant circulating through the system behave quite differently from conventional design systems. Nevertheless, it has been found that the system of FIG. 1, when operated as described above, gradually recovers a portion of its latent capacity while increasing the head pressure at low ambient temperatures and reduces its sensible capacity. This allows for an increase in supply air temperature to a desired level. Furthermore, corresponding latent efficiency enhancement is observed and although saturated suction temperature reduction is detected, this is only to an acceptable level.

In the embodiment of FIG. 2, operation follows a similar trend and system sensible capacity can be almost entirely eliminated while evaporator latent capacity as well system latent EER are held steady and at a higher level.

Figure 3:
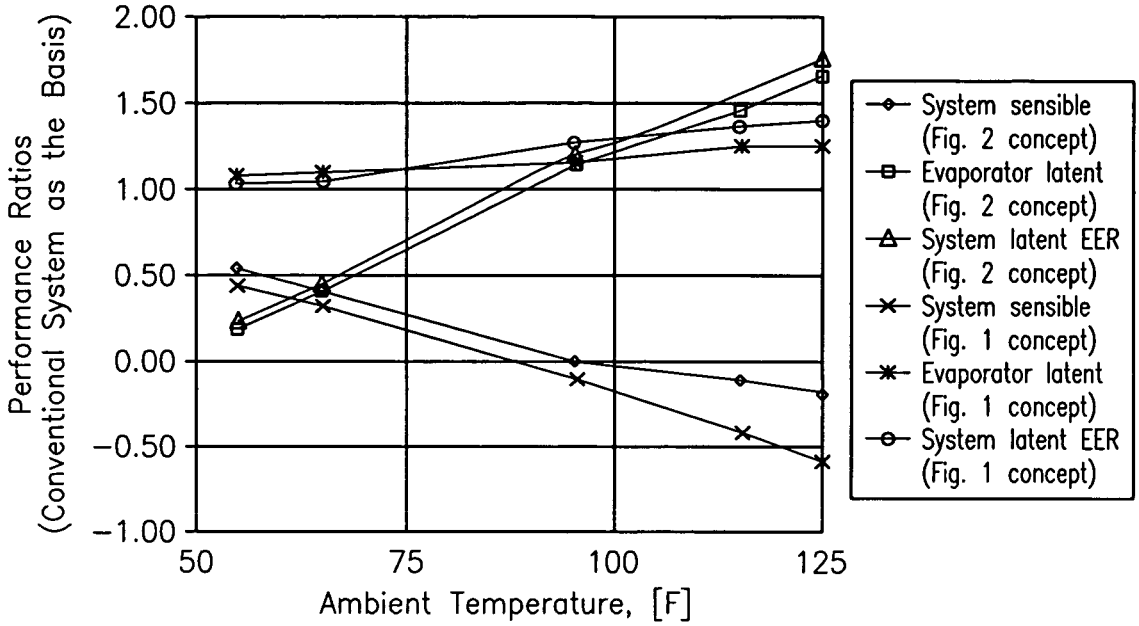
FIG. 3 illustrates performance ratios vs. ambient temperature for different types of systems.
Figure 4:
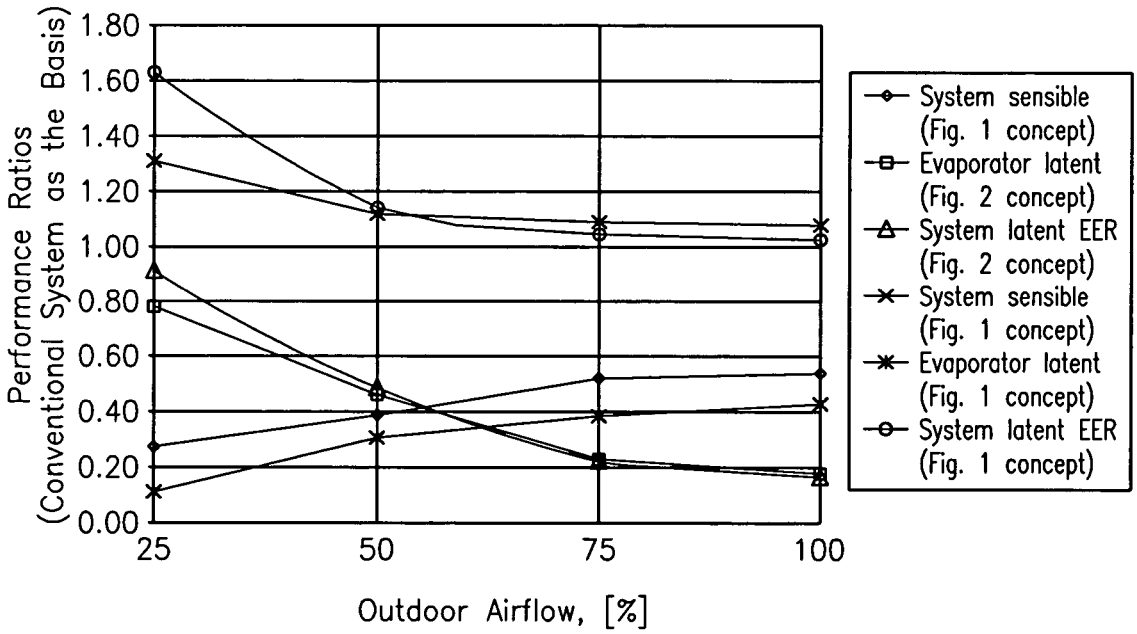
FIG. 4 illustrates performance ratios vs. % of outdoor air flow for different types of systems.

FIGS. 3 and 4 further illustrate the foregoing relationship between performance ratios and ambient temperature on the one hand, and performance ratios and outdoor air flow, as a head pressure control mechanism, on the other hand.

FIG. 3 shows a performance comparison at different ambient temperatures with a fixed reheat coil size and for various reheat concepts, and significant dehumidification performance degradation can be observed.

FIG. 4 shows relationship between performance ratios and the percentage of outdoor air flow, as a head pressure control mechanism, for different system reheat concepts and shows that the process of the present invention can be advantageously used for significant system dehumidification performance improvement.

Although the head pressure control depends on various system operating and environmental parameters, it is recommended to utilize the process of the present invention at below 75° F. ambient temperatures. This is significantly different from, and advantageous as compared to, conventional system operation which experiences the above-mentioned difficulties when operated at much lower ambient conditions.

Also, it should be noted that system reliability is improved and its operation function is enhanced due to avoidance of the two-phase refrigerant mixture entering the expansion device and evaporator coil freeze-up, thus eliminating flooding conditions at the compressor.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed:

1. A method for operating a vapor compression system, comprising the steps of:

providing a vapor compression system having a compressor circuit including a compressor having an inlet port and an outlet port, a circuit incorporating said compressor, a condenser, an evaporator and an expansion device;

operating said vapor compression system in a dehumidification mode to sequentially generate a cooling refrigerant for cooling a stream of air so as to provide a dehumidified cooled stream of air, and a reheat refrigerant for heating said dehumidified cooled stream of air to provide a reheated dehumidified stream of air; and while operating in said dehumidification mode, controlling discharge pressure from said compressor outlet so as to increase discharge pressure from said compressor outlet.

2. The method of claim 1, wherein said controlling step is carried out at ambient conditions including an ambient temperature of between about 0° F. and about 75° F.

3. The method of claim 1, wherein said controlling step comprises controlling flow rate of outside air to said system.

4. The method of claim 1, wherein said controlling step comprises controlling an amount of refrigerant flow in said system through said condenser.

5. The method of claim 1, wherein said condenser has a condenser coil, and wherein said controlling step comprises controlling flow in said circuit so as to bypass a portion of said condenser coil.

6. The method of claim 1, wherein said controlling step is carried out so as to prevent two-phase flow of refrigerant to said expansion device.

7. The method of claim 1, wherein said controlling step is carried out so as to prevent freeze-up of an evaporator coil of said evaporator.

8. The method of claim 1, wherein said controlling step is carried out so as to improve system efficiency.

9. A method for operating a vapor compression system, comprising the steps of:

providing a vapor compression system having a compressor circuit including a compressor having an inlet port and an outlet port, a circuit incorporating said compressor, a condenser, an evaporator and an expansion device for sequentially generating a cooling refrigerant for cooling a stream of air so as to provide a dehumidified cooled stream of air, and a reheat refrigerant for heating said dehumidified cooled stream of air to provide a reheated dehumidified stream of air; and controlling discharge pressure from said compressor outlet so as to increase discharge pressure from said compressor outlet, wherein said controlling step comprises restricting flow in a discharge line from said outlet port of said compressor so as to control said discharge pressure.

10. A vapor compression system, comprising:

a compressor circuit including a compressor having an inlet port and an outlet port, a circuit incorporating said compressor, a condenser, an evaporator and an expansion device operable in a dehumidification mode for sequentially generating a cooling refrigerant for cooling a stream of air so as to provide a dehumidified cooled stream of air, and a reheat refrigerant for heating said dehumidified cooled stream of air to provide a reheated dehumidified stream of air; and means for controlling discharge pressure from said compressor outlet during operation in said dehumidification mode so as to increase discharge pressure from said compressor outlet.

* * * * *